US007565783B1

(12) United States Patent
Hurst

(10) Patent No.: US 7,565,783 B1
(45) Date of Patent: Jul. 28, 2009

(54) APPARATUS FOR LOADING TRAYS

(76) Inventor: Richard F. Hurst, P.O. Box 6400, Vero Beach, FL (US) 32961

( * ) Notice: Subject to any disclaimer, the term of this patent is extended or adjusted under 35 U.S.C. 154(b) by 0 days.

(21) Appl. No.: 12/075,203

(22) Filed: Mar. 10, 2008

Related U.S. Application Data

(60) Provisional application No. 60/918,845, filed on Mar. 19, 2007.

(51) Int. Cl.
*B65B 5/10* (2006.01)

(52) U.S. Cl. ..... 53/244; 53/250; 53/253

(58) Field of Classification Search ..... 53/244, 53/250, 251, 253, 276, 317, 331.5; 198/416, 198/418.5
See application file for complete search history.

(56) References Cited

U.S. PATENT DOCUMENTS 4,094,411 A * 6/1978 Kronseder et al. ..... 209/522
4,596,107 A * 6/1986 Pfleger, Sr. ..... 53/53
4,624,098 A * 11/1986 Trendel ..... 53/331.5
4,663,913 A * 5/1987 Trendel ..... 53/331.5
4,697,691 A * 10/1987 Zodrow et al. ..... 198/418.5
4,832,173 A * 5/1989 Hattori et al. ..... 198/416
5,183,146 A * 2/1993 Reuteler ..... 198/467.1
5,282,525 A * 2/1994 Covert ..... 198/347.1
5,816,029 A * 10/1998 Sweeny ..... 53/331.5
5,934,042 A * 8/1999 Peronek ..... 53/331.5

* cited by examiner

*Primary Examiner*—Louis K Huynh
(74) *Attorney, Agent, or Firm*—Michael R. Philips

(57) ABSTRACT

Apparatus for loading trays with vials receives vials from an input channel and transmits the vials through a discharge channel to a tray for processing, e.g. autoclaving. The vials are conveyed by rotation of a pusher wheel having a series of radially extending, biased fingers on the periphery thereof. An outer guide is located adjacent to the pusher wheel to form a channel for the vials being conveyed. The side edge of the pusher wheel and an opposed side edge of the guide are formed with a lateral protrusion at the upper portion thereof to prevent tipping of the vials.

6 Claims, 3 Drawing Sheets

APPARATUS FOR LOADING TRAYS

RELATED APPLICATION

This non-provisional patent application is a conversion of provisional patent application No. 60/918,845 filed Mar. 19, 2007.

FIELD OF THE INVENTION

The present invention relates to the field of apparatus for automatically loading bottles or vials on trays for handling and further processing, particularly in the pharmaceutical field.

BACKGROUND OF THE INVENTION

Medical serums and vaccines are often packaged for shipment in unit dose vials, i.e. vials that contain enough liquid for a single dose. Unit dose vials are typically in the form of a glass container that is sealed after filling with an annular metal closure and a rubber membrane that is captured between the closure and the neck of the vial. This combination of materials is typically not affected by autoclave temperatures and is a cost effective and protective package. However, a unit dose vial is generally a fairly small container, typically on the order of 15 mm in diameter×30 mm high (⅝"×1¼"), making the vial susceptible to being tipped over during handling. Tipping a glass vial in a machine operation can cause machine jamming, vial breakage, machine process interruption and other problems.

A known apparatus for loading bottles or vials onto trays is disclosed in U.S. Pat. No. 6,089,001 to the present inventor. Whereas the apparatus described in the U.S. Pat. No. 6,089,001 is designed to convey vials from a supply conveyor to a handling tray, there is no provision for protecting against vials tipping during transport or for avoiding damage to a vial that may become caught between the index wheel and the circumferential guide. The present invention disclosed below provides an apparatus for loading trays with features to support vials against tipping in a more stable manner than known in the prior art. In addition, the present invention incorporates a feature to lessen the likelihood of vial damage and machine jamming.

SUMMARY OF THE INVENTION

The invention disclosed herein provides an apparatus for loading process handling trays with medicine vials. The apparatus utilizes an input channel and a discharge channel that are formed with a profile contour configured for holding the vials in upright orientation and preventing tipping. A pusher wheel is similarly formed to capture the vials being conveyed between the pusher wheel and an outer rail. The pusher wheel is further provided with a series of radially extending fingers that move the vials from the input channel to the discharge channel. The fingers are biased to retract and prevent damage to a vial in case of impact by a finger. Adjustment of the spacing between sides of the channels and between the pusher wheel and the outer guide, as well as height adjustment, are provided for vials of different sizes.

BRIEF DESCRIPTION OF THE DRAWINGS

The present invention is best understood in conjunction with the accompanying drawing figures in which like elements are identified by similar reference numerals and wherein.

DETAILED DESCRIPTION OF THE PREFERRED EMBODIMENT

Figure 1:
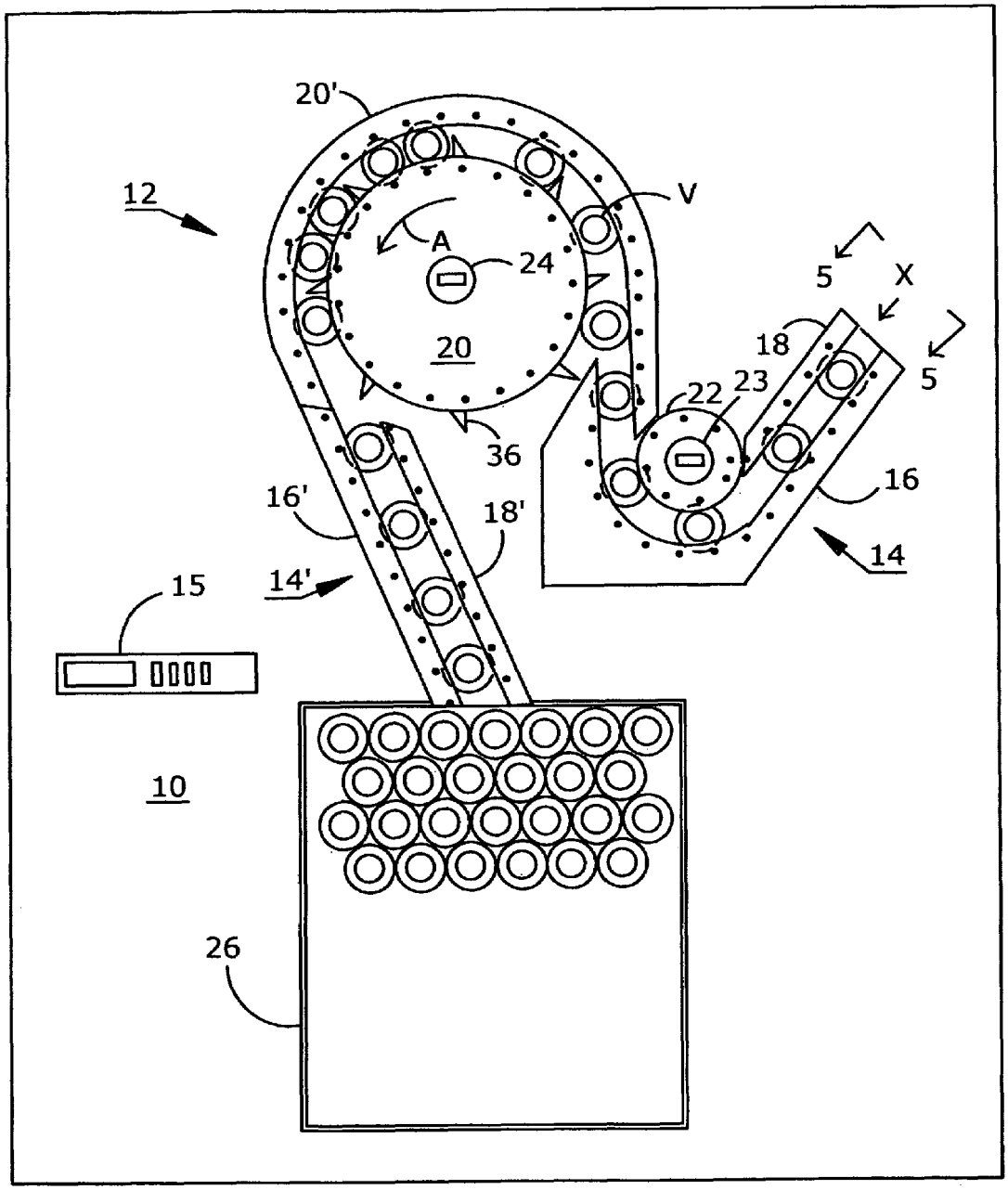
FIG. 1 is a top plan view of the apparatus for loading vials onto trays according to the present invention.

Referring now to FIG. 1, a substantially level platform 10 is provided to support the tray loading apparatus 12 of the invention. Platform 10 with the apparatus 12 for loading trays may be operated independently or incorporated into a process line in which bottles or vials V are filled, capped, etc. Vials V are loaded on trays 26, e.g. after filling and capping, for ease of handling during autoclaving and other operations. A control panel 15, e.g. a microprocessor, is provided for machine operation and is connected to drives and control circuits such as a counter for replacing a full tray 26 with an empty tray 26 when a selected quantity of vials V has been loaded. Vials V are conveyed from the filling and capping stations preceding the tray loading apparatus 12 of the present invention and introduced at entry X of input channel 14 to travel between an outer guide rail 16 and inner guide rail 18. Outer guide rail 16 and inner guide rail 18 are formed with a contour profile for supporting vials V against tipping over as will be described below. Outer guide rail 16 is preferably mounted in a fixed position on platform 10. Inner guide rail 18 is preferably mounted to platform 10 in a manner to be adjustable relative to outer guide rail 16 in order to accommodate vials V of different diameters. Alternately, both guide rails 16, 18 may be adjustable in position relative to one another. Vials V are moved sequentially along input channel 14. Channel 14 may be either curved (as shown) or as a linear configuration with sufficient length provided to accumulate a backlog of vials V and avoid gaps in the production process.

Continuing with FIG. 1, at a curve in channel 14, inner guide 18 is replaced by a guide wheel 22, and outer guide 16 is formed in an arc to curve concentrically around guide wheel 22. Changing the tray loading apparatus 12 to handle vials V of a different diameter at the arcuate portion of input channel 14 may be accommodated by replacing guide wheel 22 with a guide wheel having a different diameter, larger diameter vials V requiring a smaller diameter guide wheel 22, and vice versa. Alternately, guide wheel 22 is retained and a replacement outer guide 16 having a different curvature is mounted. Guide wheel 22 is free to rotate around shaft 23 as vials V are passed from input channel 14. Vials V continue to be conveyed past guide wheel 22 to a second portion of the channel approaching a second curve where an outer guide 20' wraps concentrically around a pusher wheel 20. Pusher wheel 20 is driven around shaft 24 in the direction indicated by arrow A by a motor (not shown). To accommodate vials V of a different diameter, pusher wheel 20 may be replaced with a similar wheel having a different diameter. As pusher wheel 20 is rotated around shaft 24, vials V are conveyed between pusher wheel 20 and outer guide 20' by a series of fingers 36 extending radially around the circumference of pusher wheel 20. Fingers 36 are spaced at equal intervals to form a plurality of pockets around the periphery of pusher wheel 20. In the embodiment shown, 8 fingers are positioned at 45° intervals to define 8 pockets. Accordingly, each finger 36 will move 1, 2 or more vials in each pocket, depending on the diameter of pusher wheel 20, the size of vials V, and the relative input vs. output vial flow speeds.

Referring further to FIG. 1, a discharge channel 14' receives the series of vials V from pusher wheel 20 and conveys vials V to a tray 26, located at the exit of discharge channel 14'. In order to maintain a cohesive geometry of vials V on tray 26, typically in a honeycomb pattern as illustrated, tray 26 is biased, e.g. by being oriented at an upward angle from channel 14' relative to level platform 10. In a further embodiment of the invention, platform 10 is mounted at an upward angle, with tray 26 oriented parallel therewith. Alternate means for biasing vials V into a snug array, e.g. a spring-loaded barrier, are considered to be within the scope of the invention.

Figure 2:
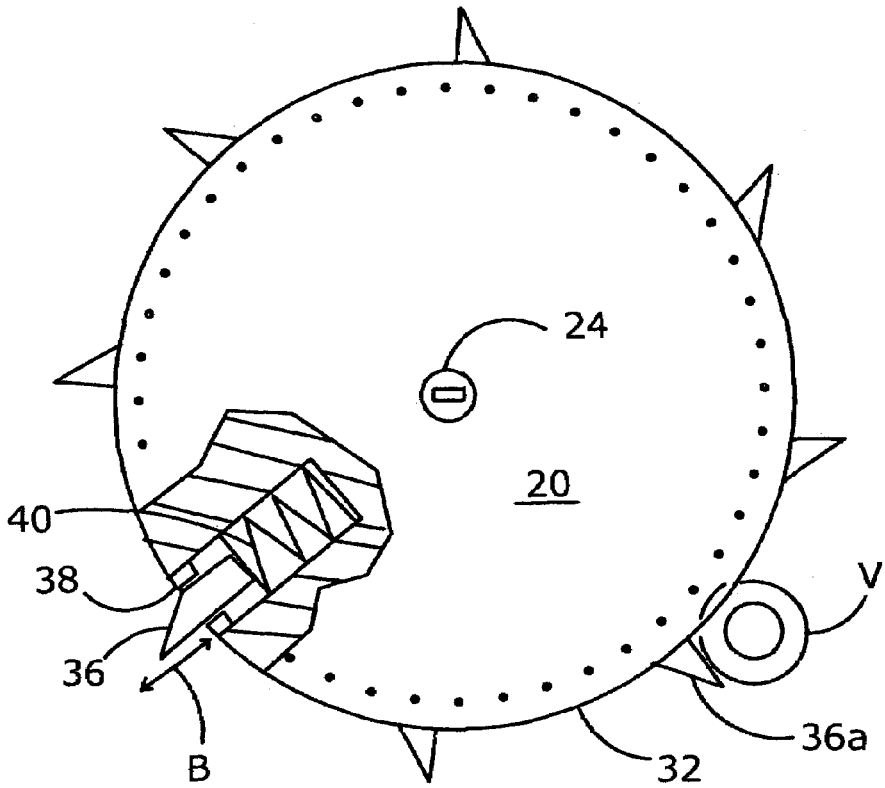
FIG. 2 is an enlarged top plan view of a pusher wheel of the present invention with a portion cut away to show internal details.
Figure 3:
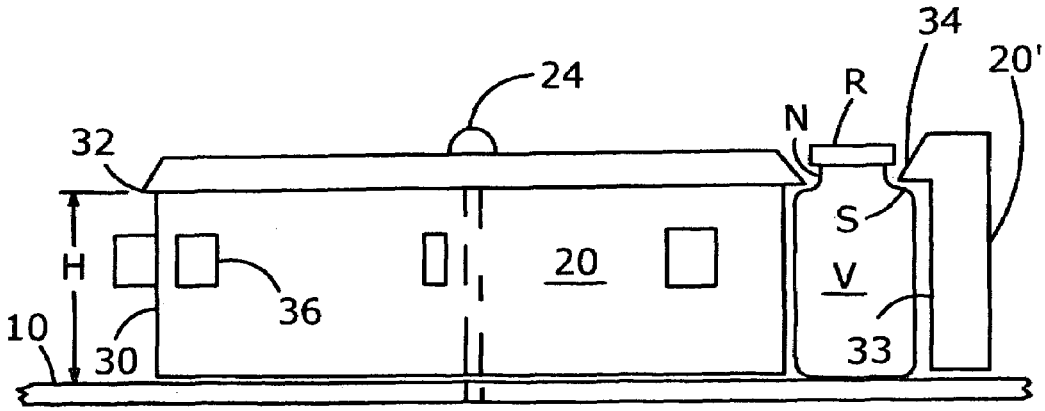
FIG. 3 is a side elevation view of the pusher wheel of FIG. 2 and an adjacent guide

Referring now to FIGS. 2 and 3, pusher wheel 20 is illustrated in top plan and elevation views with a single vial V engaged adjacent thereto. As seen in FIG. 3, vial V has a profile shape with shoulders S forming a transition from the body portion to a narrow neck N. A closure ring R is affixed to secure a sealing membrane (not shown) to neck N. Pusher wheel 20 is formed with a vertical sidewall 30 terminating at the top with a lateral protruding peripheral lip 32. Lip 32 is positioned a selected distance H above the surface of platform 10 to engage a shoulder S of vial V. Preferably, lip 32 is not in contact with shoulder S except when vial V attempts to tip over. Outer guide 20' has a vertical sidewall 33 and a peripheral lip 34 that is formed in mirror image and oriented at a height comparable to lip 32 of pusher wheel 20. To improve the stability of vial V as it is conveyed along the channel, lip 32 of pusher wheel 20, lip 34 of outer guide 20' and platform 10 form a profile contour on both sides, the top and the bottom to stabilize vial V. With a finger 36*a* pushing vial V along the channel between pusher wheel 20 and outer guide 20' (see FIG. 1), tipping of vial V is virtually prevented. In addition, it is preferred to avoid contact between the metal of closure ring R and other metal objects, e.g. pusher wheel lip 32, to prevent the generation of metal particulate. Therefore the extended lip 32 of pusher wheel 20 and lip 34 of outer guide 20' are each configured substantially in the shape of a V lying on its side to only contact the glass body portion of vial V and not contact closure ring R. To accommodate vials V of different height, pusher wheel 20 and outer guide 20' may be raised or lowered, or alternately be replaced with components of different height. Whereas the profile contour of the periphery of pusher wheel 20 and other components of the present invention are characterized as a straight vertical sidewall positioned adjacent to the body of vial V with a protruding horizontal top lip positioned adjacent to the shoulder of vial V, it is contemplated that various shapes for the profile contour may be provided according to the shape of the particular vial V being conveyed.

Referring further to FIG. 2, with pusher wheel 20 being rotated mechanically around shaft 24, it is possible that an extended finger 36 will impinge a vial V entering the channel between outer guide 20' (see FIG. 1) and pusher wheel 20. If fingers 36 were rigidly mounted to pusher wheel 20, either the impinged vial V would be damaged or the tray loading apparatus would likely become jammed. In either case, the tray loading apparatus would be stopped and possibly require maintenance. According to the present invention, fingers 36 are mounted for retracting resiliently into pusher wheel 20 if the forward edge of one finger 36 were to come into impinging contact with a vial V. Each finger 36 is mounted slidingly into a cavity 38 and each finger 36 is backed by a compression spring 40. Whereas the cross sectional shape of each finger 36 is rectangular and cavity 38 is rectangular, relative rotation therebetween does not occur. In cases where a finger 36 contacts a vial V, finger 36 is pushed radially into cavity 38 in the direction indicated by arrow B, compressing spring 40 and not damaging vial V. Vial V will typically then be rotated on its axis and finger 36 will be re-extended by spring 40. Vial V will then be conveyed around pusher wheel 20 by the next sequential finger 36 coming into position on the periphery of pusher wheel 20. The present invention contemplates alternate configurations and mountings for fingers 36.

Figure 4:
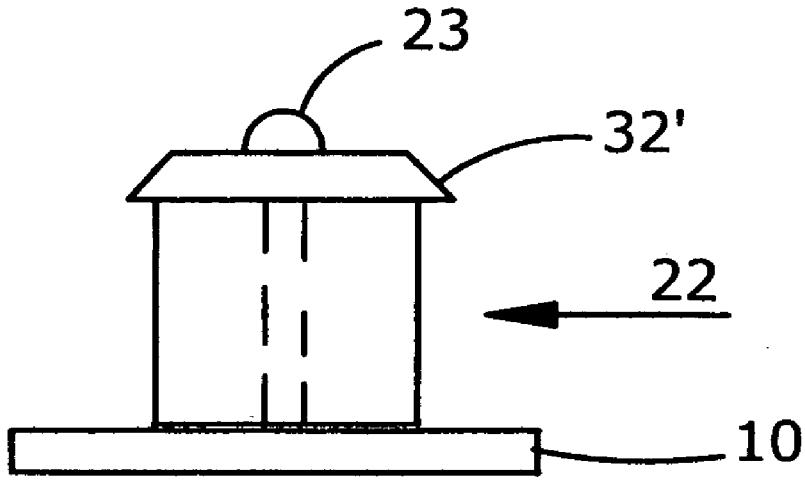
FIG. 4 is a side elevation view of a guide wheel of the invention.

Referring now to FIG. 4, guide wheel 22 is shown in side elevation. Guide wheel 22 has a lip 32' around the upper periphery that is contoured to control tipping of vials V. Lip 32' is similar in shape to lip 32 of pusher wheel 20 (see FIG. 3) when viewed in elevation. Guide wheel 22 is mounted to platform 10 (see FIG. 1) for free rotation around shaft 23.

Figure 5:
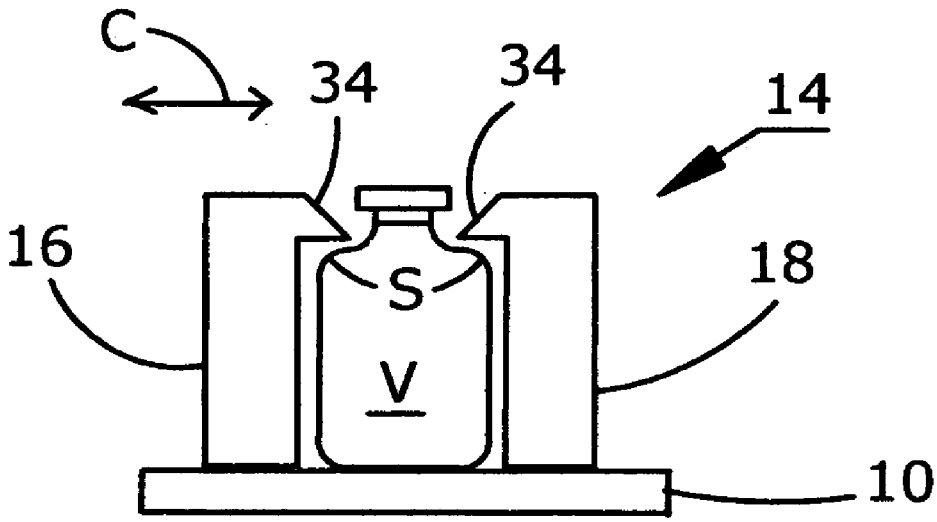
FIG. 5 is a view of the entry of a dual-sided channel taken in the direction of line 5-5 of FIG. 1.

Referring now to FIG. 5, an entry section of input channel 14 is seen in the direction indicated by line 5-5 of FIG. 1. Outer guide 16 and inner guide 18 each have an upper protruding lip 34 and are fixedly mounted to platform 10 to contain vial V and prevent it from tipping during movement. As noted above, outer guide 16 is adjustable to be closer to or further from inner guide 18 in the direction indicated by arrow C to accommodate a different diameter of vial V. In addition, a taller outer guide 16 and inner guide 18 may be substituted to accommodate a taller vial V, to position protruding lips 34 to be in contact only with the glass shoulder S of vial V. Alternately, outer guide 16 and inner guide 18 may be adjusted in height relative to platform 10 by convenient means to accommodate vials V of different heights.

While the description above discloses the preferred embodiment of the present invention, it is contemplated that numerous variations and modifications of the invention are possible and are considered to be within the scope of the claims that follow.

What is claimed is:

1. Apparatus for loading trays with vials, comprising;

a. an input channel assembled to a platform;

b. a discharge channel assembled to the platform downstream from the input channel and positioned for conveying the vials to a tray; and c. a pusher wheel mounted for rotation on the platform between the input and discharge channels for receiving the vials from the input channel and conveying the vials to the discharge channel, the pusher wheel comprising a series of radially extending fingers mounted slidingly in a series of cavities formed around the periphery of the pusher wheel, the fingers biased outwardly of the pusher wheel to enable the fingers to retract radially when contacting an obstruction;

d. wherein the input channel, the pusher wheel for receiving and conveying the vials and the discharge channel are each formed with a profile contour configured for preventing the vials from tipping.

2. The apparatus for loading trays with vials as described in claim 1, wherein the profile contour is formed to only contact selected exterior portions of the vials.

3. The apparatus for loading trays with vials as described in claim 1, wherein the profile contour comprises a vertical sidewall with a lateral protrusion at an upper portion thereof configured for engaging a shoulder of each vial and supporting the vials against tipping.

4. The apparatus for loading trays with vials as described in claim 3, wherein the lateral protrusion is located at a height to reside below a closure ring of the vials to support the vials against tipping.

5. The apparatus for loading trays with vials as described in claim 1, further comprising means to bias the vials loaded in the tray toward the discharge channel.

6. The apparatus for loading trays with vials as described in claim 5, wherein the means to bias the vials comprises mounting the tray at an upward angle to horizontal.

* * * * *